US007751742B2

(12) United States Patent
Matsudaira et al.

(10) Patent No.: US 7,751,742 B2
(45) Date of Patent: Jul. 6, 2010

(54) IMAGE FORMING APPARATUS AND IMAGE FORMING SYSTEM

(75) Inventors: Tadashi Matsudaira, Hachioji (JP); Utami Soma, Hachioji (JP); Atsushi Takahashi, Akishima (JP); Youbao Peng, Hino (JP); Hiroshi Oyama, Hino (JP); Shinpei Kawasaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 479 days.

(21) Appl. No.: 11/896,414

(22) Filed: Aug. 31, 2007

(65) Prior Publication Data

US 2008/0075497 A1 Mar. 27, 2008

(30) Foreign Application Priority Data

Sep. 25, 2006 (JP) ..... 2006-258391

(51) Int. Cl.
*G03G 15/00* (2006.01)

(52) U.S. Cl. ..... 399/88; 399/37; 399/82

(58) Field of Classification Search ..... 399/88, 399/82, 37, 33, 407
See application file for complete search history.

(56) References Cited

U.S. PATENT DOCUMENTS 5,724,630 A * 3/1998 Mashiba
6,826,377 B2 * 11/2004 Kitozaki ..... 399/88
2005/0201771 A1 * 9/2005 Mizuno ..... 399/88

FOREIGN PATENT DOCUMENTS

| | | |
|---|---|---|
| JP | 07-141060 | 6/1995 |
| JP | 2003-080804 | 3/2003 |
| JP | 2005111693 A * | 4/2005 |

OTHER PUBLICATIONS

Japanese Office Action dated Sep. 9, 2008.

* cited by examiner

*Primary Examiner*—Susan S Lee
(74) *Attorney, Agent, or Firm*—Finnegan, Henderson, Farabow, Garrett & Dunner, L.L.P.

(57) ABSTRACT

An image forming apparatus having a main body unit for forming an image on a recording medium, connectable to at least one post-processing unit for performing post-processing for the recording medium on which the image is formed, the image forming apparatus includes, a current value acquiring portion for acquiring at least one of a calculated value of a current and a measured value of the current as a value of the current flowing through the main body unit, and a control portion for selecting an operation mode from a plurality of operation modes each having a distinct value of current flowing through the main body unit.

14 Claims, 8 Drawing Sheets

FIG. 3 (A)

| OPERATION MODE OF THE IMAGE FORMING UNIT | CONSUMPTION CURRENT (A) |
|---|---|
| PRINTING ON BOTH SIDES + ADF SCAN ON BOTH SIDES | 16.5 |
| SLOWDOWN DURING OPERATION FOR BOTH SIDES | 16 |
| STARTUP OF PRINTING AFTER ADF STOP | 15 |
| ADF STOP + SLOWDOWN DURING OPERATION FOR BOTH SIDES | 14.5 |

FIG. 3 (B)

| OPERATION MODE OF THE STACKER (LS) | CONSUMPTION CURRENT (A) |
|---|---|
| PAPER STACKING | 0.65 |
| ONLY PAPER CONVEYANCE WITHOUT STACKING | 0.6 |
| ONLY CPU OPERATION | 0.5 |

FIG. 3 (C)

| OPERATION MODE OF THE SADDLE STITCHING MACHINE (SD) | CONSUMPTION CURRENT (A) |
|---|---|
| SADDLE STITCHING, FOLDING, AND CUTTING | 1.1 |
| ONLY PAPER CONVEYANCE (WITHOUT SADDLE STITCHING, FOLDING, AND CUTTING) | 0.7 |
| ONLY CPU OPERATION | 0.5 |

FIG. 3 (D)

| OPERATION MODE OF THE SIDE-STITCHING MACHINE (FS) | CONSUMPTION CURRENT (A) |
|---|---|
| SIDE-STITCHING, FOLDING, AND PUNCHING | 2.2 |
| NO OTHER OPERATIONS DURING STITCHING | 1.5 |
| ONLY PAPER CONVEYANCE (WITHOUT STITCHING, FOLDING, AND PUNCHING) | 0.7 |
| ONLY CPU OPERATION | 0.5 |

FIG. 3 (E)

| OPERATION MODE OF THE CASE BINDING MACHINE (PB) | CONSUMPTION CURRENT (A) |
|---|---|
| PASTING AND BOOKBINDING OPERATION | 3 |
| NO OTHER OPERATIONS DURING STITCHING | 2.5 |
| STANDBY (ONLY TEMPERATURE ADJUSTMENT BY THE PASTE HEATER) | 2.0 |
| ONLY CPU OPERATION | 0.5 |

FIG. 4

| | MAIN UNIT (A) | LS(A) | LS(A) | SD(A) | FS(A) | PB(A) | TOTAL CURRENT VALUE (A) | LIMITED TO 20 A |
|---|---|---|---|---|---|---|---|---|
| FULL MODE 1 | 16.5 | 0.65 | 0.65 | 1.1 | 2.2 | 3 | 24.1 | OUT LIMIT |
| FULL MODE 2 | 16.5 | 0.65 | 0.65 | 1.1 | | | 18.9 | WITHIN |
| PB FULL MODE | 16.5 | 0.6 | 0.6 | 0.7 | 0.7 | 3 | 22.1 | OUT LIMIT |
| REDUCED PB MODE | 14.5 | 0.6 | 0.6 | 0.7 | 0.7 | 2.5 | 19.6 | WITHIN |
| LS FULL MODE | 16.5 | 0.6 | 0.65 | 0.5 | 0.5 | 2 | 20.75 | OUT LIMIT |
| REDUCED LS MODE 1 | 16.5 | 0.6 | 0.65 | 0.5 | 0.5 | 0.5 | 19.25 | WITHIN |
| REDUCED LS MODE 2 | 14.5 | 0.6 | 0.65 | 0.5 | 0.5 | 2 | 19.25 | WITHIN |
| FS FULL MODE | 16.5 | 0.6 | 0.6 | 0.7 | 2.2 | 2 | 22.6 | OUT LIMIT |
| REDUCED FS MODE 1 | 16 | 0.6 | 0.6 | 0.7 | 1.5 | 0.5 | 19.9 | WITHIN |
| REDUCED FS MODE 2 | 15 | 0.6 | 0.6 | 0.7 | 2.2 | 0.5 | 19.6 | WITHIN |

IMAGE FORMING APPARATUS AND IMAGE FORMING SYSTEM

RELATED APPLICATION

This application is based on Japanese Patent Application No. 2006-258391 filed on Sep. 25, 2006 in Japanese Patent Office, the entire content of which is hereby incorporated by reference.

FIELD

The present invention relates to an image forming apparatus and image forming system for forming an image on a recording medium and, more particularly, an image forming apparatus and image forming system to which at least one post-processing unit for performing post-processing for the recording medium on which the image is formed can be connected.

BACKGROUND OF THE INVENTION

There are conventionally proposed image forming apparatuses that include a post-processing unit performing so-called post-processing, such as bookbinding achieved by saddle stitching, internal folding, and the like, for a paper bundle, whose papers are used as recording media on which images are recorded by the main unit of these image forming apparatuses, such as copying machines, printers, multi-functional peripherals, and the like.

In these image forming apparatuses, the main unit and the post-processing unit are each provided with a power supply input interface (inlet) and an output interface (outlet). When, for example, only a limited number of wall outlets are provided in a room, the outlet of the main unit is connected to the inlet of the post-processing unit so that power is supplied from the main unit to the post-processing unit. If there are pluralities of post-processing units, the main unit and the plurality of processing units may be cascaded beyond a recommended number of connections.

In such a cascade connection, the current flowing in the main unit may exceed its allowable current (current rating). To address this situation, an image forming apparatus, as disclosed in Japanese unexamined patent application No. 6-121253, has a home terminal that stops power supply when the current exceeds the allowable current, and another image forming apparatus, as disclosed in Japanese unexamined patent application No. 5-38050, has a countermeasure to, for example, reduce the current for fixing a image recorded on a recording medium so that a breaker does not trip due to a consumption current exceeding the allowable current. Another image forming apparatus, as disclosed in Japanese unexamined patent application No. 2005-3886, controls the current for fixing according to the number of connected optional units and an operation mode of the image forming apparatus so that the current flowing in the main unit does not exceed the allowable current due to power supply fluctuations.

If the power supply is stopped by the home terminal described in Japanese unexamined patent application No. 6-121253 when the consumption current exceeds the allowable current, a series of operations performed by the image forming apparatus, that is, a print and bookbinding job being executed, is completely stopped, greatly reducing the productivity of printing and bookbinding.

The image forming apparatus disclosed in Japanese unexamined patent application No. 5-38050 always takes the same countermeasure for any specified printing and bookbinding jobs. Accordingly, some processing results may not satisfy user's requests. When the current for fixing is reduced, for example, the fixing temperature drops and thus the fixing time must be prolonged. However, the prolonged fixing time makes it hard to satisfy a request for high-speed printing. With the image forming apparatus disclosed in Japanese unexamined patent application No. 2005-3886, as more optional units are connected, the current flowing in the optional units is increased, making it difficult to obtain the amount of current necessary for fixing.

SUMMARY

An object of the present invention is to provide an image forming apparatus and image forming system that can form images safely with high throughput even post-processing units are cascaded.

To achieve the above object, according to one aspect of the present invention, there is provided an image forming apparatus having a main body unit for forming an image on a recording medium, connectable to at least one post-processing unit for performing post-processing for the recording medium on which the image is formed, the image forming apparatus comprising: a current value acquiring portion for acquiring at least one of a calculated value of a current flowing through the main body unit calculated based on a relation between an operation and a consumption current flowing in the main body unit and based on a relation between an operation and a consumption current flowing in each post-processing unit supplied an electric power from the main body unit, and a measured value of the current flowing through the main body unit, as a value of the current flowing through the main body unit; and a control portion comprising for selecting an operation mode from a plurality of operation modes having a distinct value of current flowing in each post-processing portion, selecting an operation mode to optimally operate each post-processing unit from the plurality of operation modes so that the value of the current flowing through the main body unit becomes below or equal to an allowable current value, in a case when the value of the current acquired by the current value acquiring portion exceeds the allowable current, and operating each unit according to selected mode.

According to a different aspect of the present invention, there is provided an image forming apparatus having a main body unit for forming an image on a recording medium, connectable to at least one post-processing unit for performing post-processing for the recording medium on which the image is formed, the image forming apparatus comprising:

a current detecting portion for detecting a current flowing through the main body unit;

a recognizing portion for recognizing a post-processing unit connected to the main body unit based on a content of a communication between units;

a specifying portion for specifying a post-processing unit as being supplied an electric power from the main body unit, from the post-processing units recognized as being connected to the main body unit by the recognizing portion, based on a current variation detected by the current detecting portion upon the post-processing being individually operated;

a current value acquiring portion comprising a calculating portion for calculating a maximum value of the current flowing through the main body unit based on a relation between a consumption current and a operation in main body unit and on a relations between a consumption current and an operation in a specified post-processing unit, for acquiring at least either one of a calculated value of the current flowing through the main body unit and a measured value of the current flowing in the main body unit as a value of current flowing through the main body unit; and a control portion for operating individually each post-processing unit connected to the main body unit, the control portion selecting an operation mode from a plurality of different operation modes to optimally operate each post-processing unit supplied an electric power from the main body unit upon the current value acquired by the current value acquiring portion exceeding an allowable current value so that the value of the current flowing through the main body unit becomes below or equal to an allowable current value, and operating each post-processing unit according to a selected operation mode.

BRIEF DESCRIPTION OF THE DRAWINGS

FIGS. 3(A) to 3(E) are tables indicating exemplary operation modes of individual units.

FIG. 4 indicates exemplary operation modes of the image forming system.

DESCRIPTION OF THE PREFERRED EMBODIMENT

An embodiment of the present invention will be described below in detail with reference to the drawings.

Figure 1:
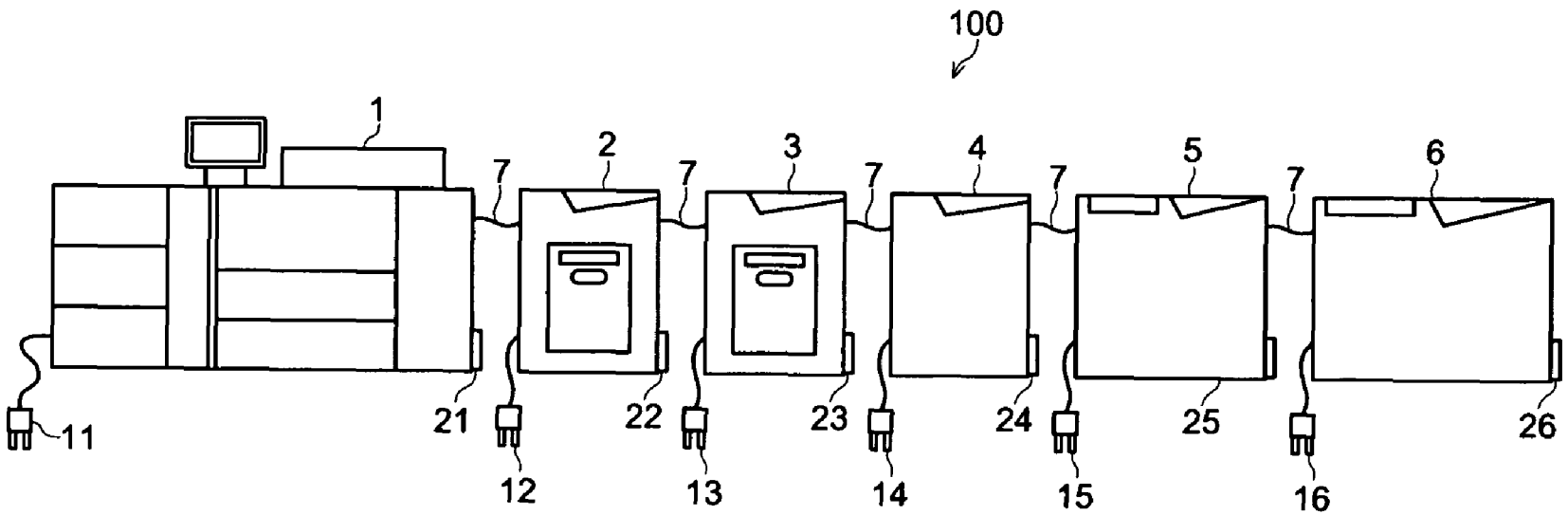
FIG. 1 is an external view schematically showing the structure of an image forming system according to an embodiment of the present invention.

FIG. 1 schematically shows the structure of an image forming system according to this embodiment. As shown in FIG. 1, the image forming system 100 comprises an image forming unit 1 and post-processing units 2, 3, 4, 5, and 6. The image forming unit 1 is connected to the post-processing units 2 to 6 through a serial communication interface 7, enabling data communication among them. In FIG. 1, the image forming unit 1 and post-processing units 2 through units 6 are separated from one another to prevent the drawing from becoming complicated. In practice, however, the image forming unit 1 and post-processing units 2 through units 6 are disposed in tight contact with one another so that a recording media (referred to below as a paper sheet) such as a paper sheet is transferred from the image forming unit 1 to the post-processing units 2, 3, 4, 5, and 6 in that order.

The image forming unit 1 is the main unit of the image forming apparatus for forming an image on a paper sheet. The image forming unit 1 creates a print job, which is a control command sequence to perform image forming, on the basis of commands, such as for automatic document feeding, one-side printing, and both-side printing, entered through an operation panel (not shown) or local area network (LAN) (not shown), forms an image on a paper sheet according to the print job, and ejects the paper sheet to the post-processing unit 2. The image forming unit 1 has an inlet 11 with a plug, which is used as an input interface of power; power is supplied through the inlet 11. The power supplied through the inlet 11 can also be output to the outside through an outlet 21, which is an output interface of power.

The post-processing units 2 to 6 perform various types of post-processing on paper sheets on which images are formed by the image forming unit 1. In this embodiment, the post-processing unit 2 is a stacker (denoted LS in some drawings) that stacks a predetermined number of paper sheets, on which images are recorded, ejected from the image forming unit 1 as one bundle, and laminates bundles with each bundle having a little offset. The post-processing unit 3 is also a stacker that stacks a predetermined number of paper sheets transferred from the post-processing unit 2 as one bundle and laminates bundles with each bundle having a little offset. The post-processing unit 4 is a saddle stitching machine (denoted SD in some drawings) that staples paper sheets in folio at the center to create a booklet. The post-processing unit 5 is a side-stitching machine (denoted FS in some drawings) that staples stacked paper sheets at specified positions, for example, at one upper-left position, two positions on the left side, one upper-right position, or two positions at the top. The post-processing unit 6 is a case binding machine (denoted PB in some drawings) aligns output paper sheets, applies special paste to the back for bonding, wraps the output paper sheets with covers, and finally performing pressing.

The post-processing units 2 to 6 respectively have inlets 12 to 16 similar to the inlet 11 and outlets 22 to 26 similar to the outlet 21. Section of power supplied through the inlet 12 can be output from the outlet 22 as it is; section of power supplied through the inlet 13 can be output from the outlet 23 as it is; section of power supplied through the inlet 14 can be output from the outlet 24 as it is; section of power supplied through the inlet 15 can be output from the outlet 25 as it is; section of power supplied through the inlet 16 can be output from the outlet 26 as it is. The inlets 11 to 16 and outlets 21 to 26 are each provided according to the same standard, so the inlets can be inserted into the outlets.

Figure 2:
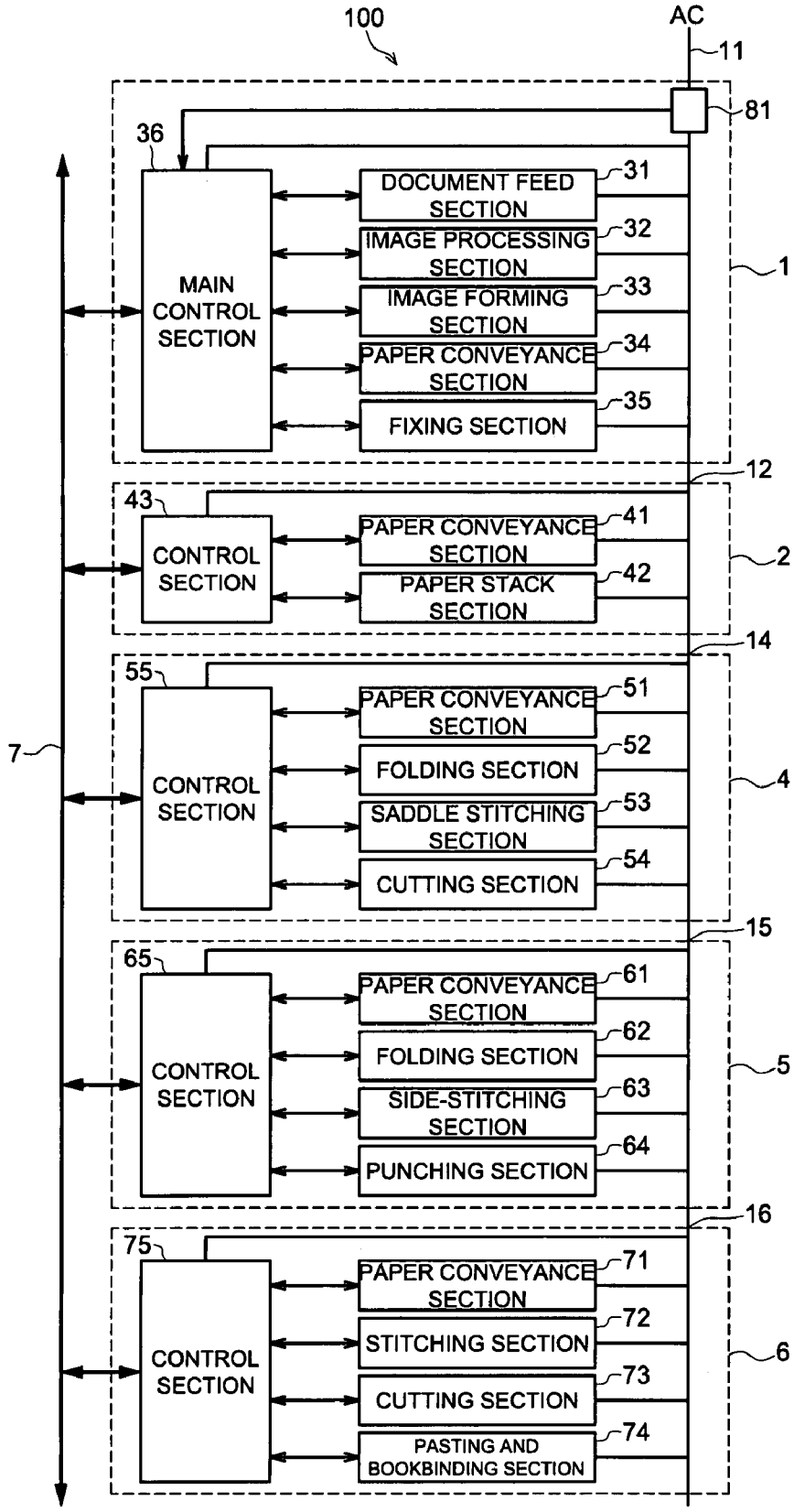
FIG. 2 is a functional block diagram showing the internal structure of the image forming system in FIG. 1.

FIG. 2 schematically shows the internal structures of the units in the image forming system 100. In FIG. 2, the post-processing unit 3 is omitted to simplify explanation. In FIG. 2 again, the power supply lines of the image forming unit 1 and the post-processing unit 2, 4, 5, and 6 are cascaded by connecting their inlets and outlets.

As shown in FIG. 2, the image forming unit 1 comprises a document feed section 31, an image processing section 32, an image forming section 33, a paper conveyance section 34, a fixing section 35, and a main control section 36. The document feed section 31 feeds a document placed on a document table (not shown) to an image reading position. The image processing section 32 uses a CCD image sensor (not shown) to read (scan) images on one side or both sides, and performs analog processing, analog-to-digital conversion, shading compensation, image compression processing, and other image processing. The document on the document table is then conveyed to a document ejection table (not shown). This type of document feed operation will also be referred to as auto document feeder (ADF) operation.

The image forming section 33 performs latent image formation on a photosensitive drum (not shown) by charging and exposure, development, transfer, separation, cleaning, and other processing, according to the result of aforementioned image processing. In this transfer processing, an image read from a document, for example, is transferred to a paper sheet conveyed by the paper conveyance section 34. The paper sheet to which the image has been transferred is further conveyed to the fixing section 35 by the paper conveyance section 34; the image is fixed on the paper sheet by a fixing heater included in the fixing section 35. The paper conveyance section 34 then ejects the paper sheet outside (of the post-processing unit 2). This operation will also be referred to below as the print operation.

When the print operation is performed on both sides, the paper conveyance section 34 inverts the paper sheet, on one side of which an image has been formed, and the image forming section 33 forms an image on the other side. In this case, the paper conveyance section 34 inverts the paper at very high speed to prevent the paper sheet from coming into contact with a subsequent paper sheet.

Since the image forming unit 1 operates as both a copying machine and a printer, the image formed on a paper sheet is not necessarily the image read from the document fed by the document feed section. It is needless to say that an image may also be formed on a paper sheet, according to image data sent from, for example, a personal computer. Therefore, it is possible that the above ADF operation and print operation can be performed independently of each other.

A current sensor 81 is provided on the inlet 11 side of the power supply line in the image forming unit 1. A current value sensed by the current sensor 81 is sent to the main control section 36.

The main control section 36 controls the document feed section 31, image processing section 32, image forming section 33, paper conveyance section 34, and fixing section 35 in a centralized manner. Accordingly, the above ADF operation and print operation are performed under control by the main control section 36. The main control section 36 has a CPU, a memory, a ROM, and the like. This ROM stores a control program; when the control program is executed by the CPU, functions of the main control section 36 are implemented.

The main control section 36, document feed section 31, image processing section 32, image forming section 33, paper conveyance section 34, and fixing section 35 each receive power that is input from the inlet 11. The image forming unit 1 has a converter (not shown) for converting an AC voltage that the image forming unit 1 receives into a DC voltage. The converter applies DC voltages, such as at 24 V and 5 V, to individual sections. For example, a 5-V voltage is supplied to the main control section 36, the image processing section 32, etc., and a 24-V voltage is supplied to other sections.

The sections 31 to 35 are designed so that they operate in an operation mode set by the main control section 36. The main control section 36 selects one operation mode from several different operation modes and sets the selected operation mode in an internal RAM; the main control section 36 then controls the sections 31 to 35 in the set operation mode.

For example, the table in FIG. 3(A) indicates exemplary operation modes. In the operation mode listed at the top, called "printing on both sides+ADF scan on both sides", the ADF operation for both sides, in which the images on both sides of a document transferred by the document feed section 31 are read, and the print operation for both sides of a paper sheet are performed at the same time. In this operation mode, the current flowing in the image forming unit 1 is predetermined to be 16.5 A. When the ADF operation for both sides and the print operation for both sides, including an operation to invert the paper sheet, are performed at the same time, the individual sections in the image forming unit 1 fully operate, so this value of 16.5 A is the maximum of the consumption currents in all operation modes that the image forming unit 1 can enter.

In the next operation mode, called "slowdown during operation for both sides", the ADF operation for both sides, in which images on both sides of a document transferred by the document feed section 31 are read, and the print operation for both sides of a paper sheet are performed at the same time, the paper conveyance speed being reduced during the print operation for both sides so as to provide a spacing between paper sheets. When the paper conveyance speed is reduced to provide a spacing between paper sheets, the speed of the operation for the document feed section 31 to invert the paper sheet can be reduced. Although the entire processing time is prolonged, the consumption current at that time can be reduced. As indicated in the table in FIG. 3(A), the consumption current of the image forming unit 1 in this operation mode is restrained to 16 A.

In the next operation mode, called "startup of printing after ADF stop", the print operation is started after the ADF operation having being performed. In this operation mode, since the ADF operation and print operation are performed separately in a time-sharing manner, the entire processing time is prolonged, as compared with the "printing on both sides+ADF scan on both sides" operation mode, but the consumption current can be restrained to a low value. As indicated in the table in FIG. 3(A), the consumption current of the image forming unit 1 in this mode is 15 A.

In the next operation mode, called "ADF stop+slowdown during operation for both sides", the print operation is started after the ADF operation is performed, but the paper transfer speed is reduced during the print operation for both sides. In this operation mode, since the print speed during printing on both sides is reduced as in the "slowdown during operation for both sides" operation mode, the entire processing time is prolonged as compared with the "startup of printing after ADF stop" operation mode, but the consumption current can be restrained to a low value. As indicated in the table in FIG. 3(A), the consumption current is 14.5 A.

The main control section 36 sets any of the above operation modes according to the value of the consumption current, as will be described later, and controls the operations of the sections 31 to 35. That is, the operations of the sections 31 to 35 are restricted by the set operation mode.

The post-processing unit 2 (stacker) comprises a paper conveyance section 41, a paper stack section 42, and a control section 43, as shown again in FIG. 2. The paper conveyance section 41 performs a paper conveyance operation in which a paper sheet is conveyed. The paper stack section 42 performs a stack operation in which paper sheets conveyed by the paper conveyance section 41 are stacked. The control section 43 controls the paper conveyance section 41 and paper stack section 42 in an integrated manner. The paper conveyance section 41, paper stack section 42, and control section 43 each receive power supplied through the inlet 12.

The table in FIG. 3(B) indicates exemplary operation modes of the post-processing unit 2. In the operation mode called "paper stacking" listed at the top in FIG. 3(B), a paper transfer operation by the paper conveyance section 41 and a paper stack operation by the paper stack section 42 are performed at the same time. The consumption current in this operation mode is 0.65 A. This value of 0.65 A is the maximum of the consumption currents in all operation modes that the post-processing unit 2 can enter.

In the next operation mode called "only paper conveyance without stacking", only a paper conveyance operation is performed by the paper conveyance section 41. In this mode, the conveyed paper sheet is ejected to the post-processing unit 3. The consumption current in this operation mode is 0.6 A.

In the next operation mode called "only CPU operation", background processing is performed by the CPU in the control section 43. The consumption current in this operation mode is 0.5 A.

The control section 43 sets any of these operation modes according to a command sent from the main control section 36 in the image forming unit 1 through the serial communication interface 7, as will be described later, and controls the operations of the sections 41 and 42. The sections 41 and 42 operate according to the set operation mode. That is, the operations of the sections 41 and 42 are restricted by the set operation mode. The structure of the post-processing unit 3 is the same as the structure of the post-processing unit 2, and its operation modes are also as indicated in FIG. 3(B).

The post-processing unit 4 (saddle stitching machine) comprises a paper conveyance section 51, a folding section 52, a saddle stitching section 53, a cutting section 54, and a control section 55, as shown again in FIG. 2. The paper conveyance section 51 performs a paper conveyance operation in which paper sheets are conveyed. The folding section 52 performs a folding operation in which paper sheets are folded. The saddle stitching section 53 performs a saddle stitching operation. The cutting section 54 performs a cutting operation for stitched paper sheets. The control section 55 controls other sections 51 to 54. The sections 51 to 54 each receive power supplied through the inlet 14.

The table in FIG. 3(C) indicates exemplary operation modes of the post-processing unit 4. In the operation mode called "saddle stitching, folding, and cutting" listed at the top in FIG. 3(C), a saddle stitching operation, folding operation, and cutting operation are performed at the same time. The consumption current in this operation mode is 1.1 A. This value of 1.1 A is the maximum of the consumption currents in all operation modes that the post-processing unit 4 can enter.

In the next operation mode called "only paper conveyance (without stitching, folding, and cutting)", only a paper conveyance operation is performed by the paper conveyance section 51. As indicated in FIG. 3(C), the consumption current of the post-processing unit 4 in this operation mode is 0.7 A.

In the next operation mode called "only CPU operation", background processing is performed by the CPU in the control section 55. As indicated in the table in FIG. 3(C), the consumption current of the post-processing unit 4 in this operation mode is 0.5 A.

The control section 55 sets any of these operation modes according to a command sent from the main control section 36 in the image forming unit 1 through the serial communication interface 7, as will be described later, and controls the operations of the sections 51 to 54. The sections 51 to 54 operate according to the set operation mode, as will be described later. That is, the operations of the sections 51 to 54 are restricted by the set operation mode.

The post-processing unit 5 (side-stitching machine) comprises a paper conveyance section 61, a folding section 62, a side-stitching section 63, a punching section 64, and a control section 65, as shown again in FIG. 2. The paper transfer section 61 performs a paper transfer operation. The folding section 62 performs a folding operation for paper sheets. The side-stitching section 63 performs a saddle stitching operation. The punching section 64 performs a punching operation for stitched paper sheets. The control section 65 controls other sections 61, 62, 63, and 64. The sections 61, 62, 63, and 64 each receive power supplied through the inlet 15.

The table in FIG. 3(D) indicates exemplary operation modes of the post-processing unit 5. In the operation mode called "side-stitching, folding, and punching" listed at the top in FIG. 3(D), a side-stitching operation, folding operation, and punching operation are performed at the same time. The consumption current of the post-processing unit 5 in this operation mode is 2.2 A. This value of 2.2 A is the maximum of the consumption currents in all operation modes that the post-processing unit 5 can enter.

In the next operation mode called "no other operations during stitching", a side-stitching operation and other operations are performed separately in a time-sharing manner.

In this operation mode, after paper sheets have been conveyed, a side-stitching operation and other operations are performed. The consumption current of the post-processing unit 5 in this operation mode is 1.5 A, but the processing time is prolonged as compared with the above "side-stitching, folding, and punching" operation mode.

In the next operation mode called "only paper conveyance (without stitching, folding, and cutting)", only a paper conveyance operation is performed. The consumption current of the post-processing unit 5 in this operation mode is 0.7 A.

In the next operation mode called "only CPU operation", background processing is performed by the CPU in the control section 65. The consumption current of the post-processing unit 4 in this operation mode is 0.5 A.

The control section 65 sets any of these operation modes according to a command sent from the main control section 36 in the image forming unit 1 through the serial communication interface 7, as will be described later, and controls the operations of the sections 61 to 64. The sections 61 to 64 operate according to the set operation mode. That is, the operations of the sections 61 to 64 are restricted by the set operation mode.

The post-processing unit 6 comprises a paper conveyance section 71, a stitching section 72, a cutting section 73, a pasting and bookbinding section 74, and a control section 75, as shown again in FIG. 2. The paper conveyance section 71 performs a paper conveyance operation. The stitching section 72 performs a stitching operation for paper sheets. The cutting section 73 performs a cutting operation for stitched paper sheets. The pasting and bookbinding section 74 performs a pasting and bookbinding operation for a cut paper bundle. The pasting and bookbinding section 74 includes a paste heater that adjusts the temperature of paste used for pasting. Usually, the paste heater is always adjusting the paste temperature even while the pasting and bookbinding operation is not in progress. The control section 75 controls other sections 71 to 73. These sections each receive power supplied through the inlet 16.

The table in FIG. 3(E) indicates exemplary operation modes of the post-processing unit 6. In the operation mode called "pasting and bookbinding operation" listed at the top in FIG. 3(E), a stitching operation, cutting operation, and pasting and bookbinding operation are performed at the same time. The consumption current in this operation mode is 3 A. This value of 3 A is the maximum of the consumption currents in all operation modes that the post-processing unit 6 can enter.

In the next operation mode called "no other operations during stitching", a stitching operation and other operations are performed separately in a time-sharing manner. The consumption current in this operation mode is 2.5 A, but the processing time is prolonged as compared with the above "pasting and bookbinding operation" operation mode.

In the next operation mode called "standby (only temperature adjustment by the paste heater)", the paste heater in the pasting and bookbinding section 74 is used to perform only paste temperature adjustment, and the other sections are placed in a standby state. The consumption current in this operation mode is 2.0 A.

In the next operation mode called "only CPU operation", background processing is performed by the CPU in the control section 75. The consumption current of the post-processing unit 4 in this operation mode is 0.5 A.

The control section 75 sets any of these operation modes according to a command sent from the main control section 36 in the image forming unit 1 through the serial communication interface 7, as will be described later, and controls the operations of the sections 71 to 74. The sections 71 to 74 operate according to the set operation mode. That is, the operations of the sections 71 to 74 are restricted by the set operation mode.

The current rating of the image forming unit 1 is 20 A, making it necessary to control the current flowing in the image forming unit 1 within 20 A. When, for example, the current flowing in the image forming unit 1 exceeds the current rating, various operation modes, as described above, such as 1) the operation of the paste heater is stopped in the pasting and bookbinding section 74 in the post-processing unit 6 stops, 2) the paper conveyance speed is reduced in the print operation by the image forming unit 1 for both sides, and 3) the paper conveyance operation and the stitching operation are not performed at the same time, so the operations of the relevant units are restricted. Accordingly, the consumption current of the image forming unit 1 is controlled to a low value.

The main control section 36 in the image forming unit 1 determines not only an operation mode for the image forming unit 1 but also operation modes, shown in FIG. 3(B) to FIG. 3(E), for the above post-processing units 2 to 6. That is, the main control section 36 in the image forming unit 1 can determine all operation modes in the image forming system 100. The control units 43, 55, 65, and 75 are notified of the operation modes determined by the main control section 36 through the serial communication interface 7. The control units 43, 55, 65, and 75 then control the operations of individual sections according to the operation modes of which they are notified.

Figure 5:
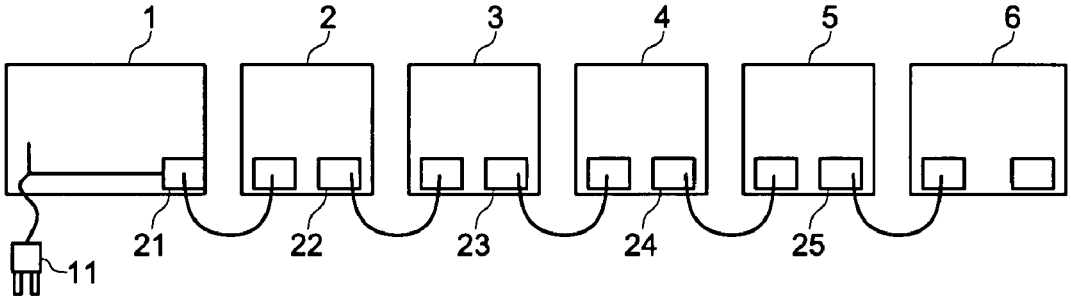
FIGS. 5(A) and 5(B) show exemplary connection modes of power supply cords in the image forming system.
Figure 5:
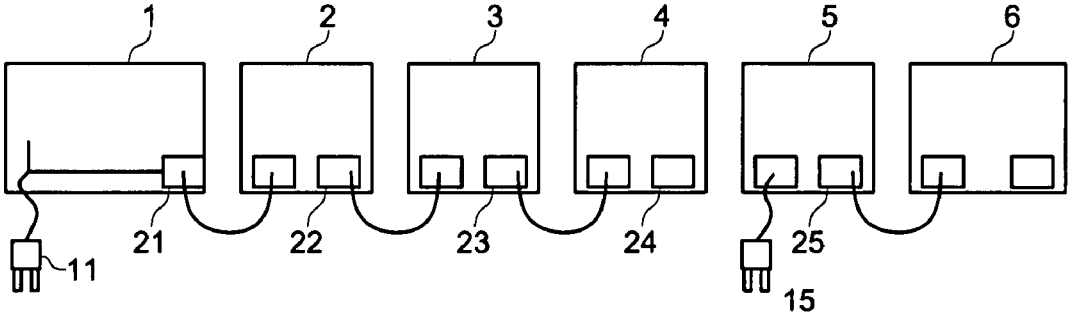

FIG. 4 indicates some exemplary combinations of these operation modes. In the operation mode at the top in the table in FIG. 4, the power supply lines of all post-processing units 2 to 6 are cascaded to the image forming unit 1, and power is supplied from the image forming unit 1 as shown in FIG. 5(A), all these units being fully operated. In this operation mode (that is, all units are operated in a full mode), the current flowing in the image forming unit 1 is 24.1 A, greatly exceeding the current rating (20 A).

In the mode shown in the line below the top line, the post-processing units 2, 3, and 4 receive power from the image forming unit 1, and the post-processing units 5 and 6 receive power from another power supply, as shown in FIG. 5(B); all these units are fully operated. In this operation mode, the current flowing in the image forming unit 1 is 18.9 A, which is less than the 20-A current rating. Accordingly, in the image forming system 100, the connection mode shown in FIG. 5(B) rather than the connection mode shown in FIG. 5(A) is recommended.

The two operation modes in the lines following the above mode are PB operation modes performed when the user specifies case binding. The main operations in these PB operation modes are image formation by the image forming unit 1 (that is, the ADF operation and print operation), and binding operation by the case binding machine PB (that is, the stitching operation, cutting operation, and pasting and bookbinding operation). In the PB full mode in the upper line, the image forming unit 1 is set to the "printing on both sides+ADF scan on both sides" operation mode and the post-processing unit 6 is set to the "pasting and bookbinding" operation mode; the post-processing units 2, 3, 4, and 5 other than the post-processing unit 6 only transfer paper sheets. In this operation mode, the current flowing in the image forming unit 1 is 22.1 A, exceeding the 20-A current rating.

In the reducing PB mode below the PB full mode as well, a case binding operation is performed. However, the operation mode of the image forming unit 1 is set to "ADF stop+slowdown during operation for both sides"; the ADF operation and print operation are performed separately in a time-sharing manner, and the print speed during printing by the main unit on both sides is reduced with a space left between paper sheets. In addition, the operation mode of the post-processing unit 6 is set to an operation mode in which the stitching operation and other operations are not performed at the same time. When the ADF operation and print operation are not performed at the same time, the printing speed during printing on both sides is reduced, and the stitching operation and other operations are not performed at the same time as described above, the current flowing in the image forming unit 1 is 19.6 A, which is lower than the current rating (20 A). Accordingly, when the units are connected as shown in FIG. 5(A) and case binding is specified by the user, the reducing PB mode in the lower line, rather than the PB operation mode in the upper line, is set.

The three modes in the lines following the above modes are LS operation modes executed when the user commands the post-processing unit 3 to perform a stack operation. The main operations in these LS operation modes are image formation by the image forming unit 1 and the stack operation by the post-processing unit 3. In these modes, the post-processing unit 2 can simply perform a paper conveyance operation to convey paper sheets to the post-processing unit 3, the post-processing units 4 and 5 downstream of the post-processing unit 3 can simply perform a CPU operation, and post-processing unit 6 downstream of the post-processing units 4 and 5 can simply perform a standby operation (only temperature adjustment is performed by the paste heater).

In the LS full mode in the top line of the three LS modes, the entire system is operated with the image forming unit 1 set to the "printing on both sides+ADF scan on both sides" operation mode and the post-processing unit 3 set to "paper stacking" operation mode. In this operation mode, the current flowing in the image forming unit 1 is 20.75 A, exceeding the current rating.

Two reduced LS modes 1 and 2 follow the LS full mode. In the reduced LS mode 1 in the upper line, the post-processing unit 6 is set to the "only CPU operation" mode rather than "standby" operation mode. In this mode, the current flowing in the image forming unit 1 is 19.25 A. From the viewpoint of throughput, when the power supply of the paste heater, which takes much time to warm up after power-up, is turned off, it takes time to recover. Since the current flowing in the image forming unit 1 is limited to or below the current rating, however, this operation mode can be set.

In the reduced LS mode 2 in the line below the reduced LS mode 1, the image forming unit 1 is set to the "startup of printing after ADF stop" operation. In this operation mode, the current flowing in the image forming unit 1 is 19.25 A. When this operation mode is set, the print operation in the image forming unit 1 is performed without any restrictions after the ADF operation is completed.

The three modes in the line below the reduced LS mode 2 are FS operation modes that are set when the user specifies side-stitching. In the FS full mode at the top, the image forming unit 1 is fully operated without any restrictions, the operation modes of the post-processing units 2, 3, and 4 are set to "only paper transfer", and the post-processing unit 6 is placed in the standby state (only temperature adjustment is performed by the paste heater). In this operation mode, the current flowing in the image forming unit 1 is 22.6 A, exceeding the current rating (20 A). In the reduced FS mode 1 listed next, the operation mode of the image forming unit 1 is set to "slowdown during operation for both sides" in which the printing speed during printing on both sides is reduced, the operation mode of the post-processing unit 5 is set to "no other operations during stitching", and the operation mode of the post-processing unit 6 is set to "only CPU operation (paste heater turned off)". In this operation mode, the current flowing in the image forming unit 1 is 19.9 A. In the reducing FS mode 2 listed next, the operation mode of the image forming unit 1 is set to "startup of printing after ADF stop", and the operation mode of the post-processing unit 6 is set to "only CPU operation". In this operation mode, the current flowing in the image forming unit 1 is 19.6 A.

The main control section 36 in the image forming unit 1 has an operation mode management table (not shown) in which various operation modes, as shown in the table in FIG. 4, are stored. The operation mode management table indicates the relation between the operation and consumption current in the image forming unit 1 and the relation between the operation and consumption current in the post-processing units 2 to 6. The main control section 36 references this operation mode management table to select operation modes, in which the individual units 1 to 6 optimally operate, from a plurality of different operation modes corresponding to various jobs based on commands from the user. The main control section 36 then controls the control sections of the units 2 to 6 in a centralized manner through the serial communication interface 7 according to the selected operation modes, and restricts the operations of the units 1 to 6.

Figure 6:
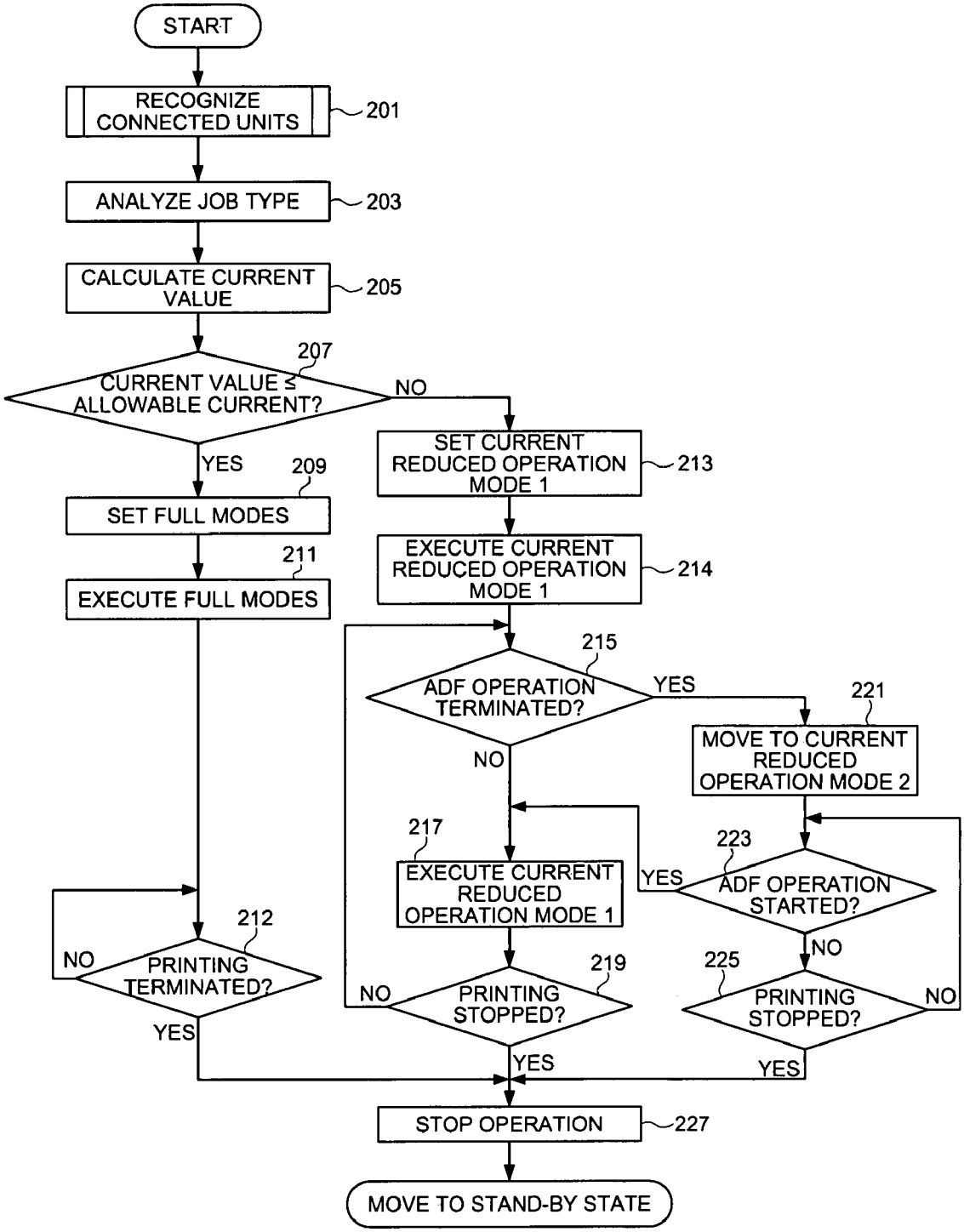
FIG. 6 is a flowchart indicating exemplary processing to determine an operation mode during initial operation immediately after power-up.

Next, the operation of the image forming system 100 according to this embodiment will be described with reference to mainly flowcharts. The initial operation of the image forming system 100, which is performed after power is turned on, will be described first. FIG. 6 is a flowchart for processing in which the main control section 36 in the image forming unit 1 determines an operation mode of the image forming system 100 in the initial operation. FIG. 6 illustrates a case in which operation modes comprising two current reducing modes, such as LS operation modes or FS operation modes as indicated in the table in FIG. 4, are determined.

First, in step 201, the main control section 36 executes a connected unit recognition subroutine that recognizes which post-processing units are connected to the image forming unit 1, as shown in FIG. 6.

Figure 7:
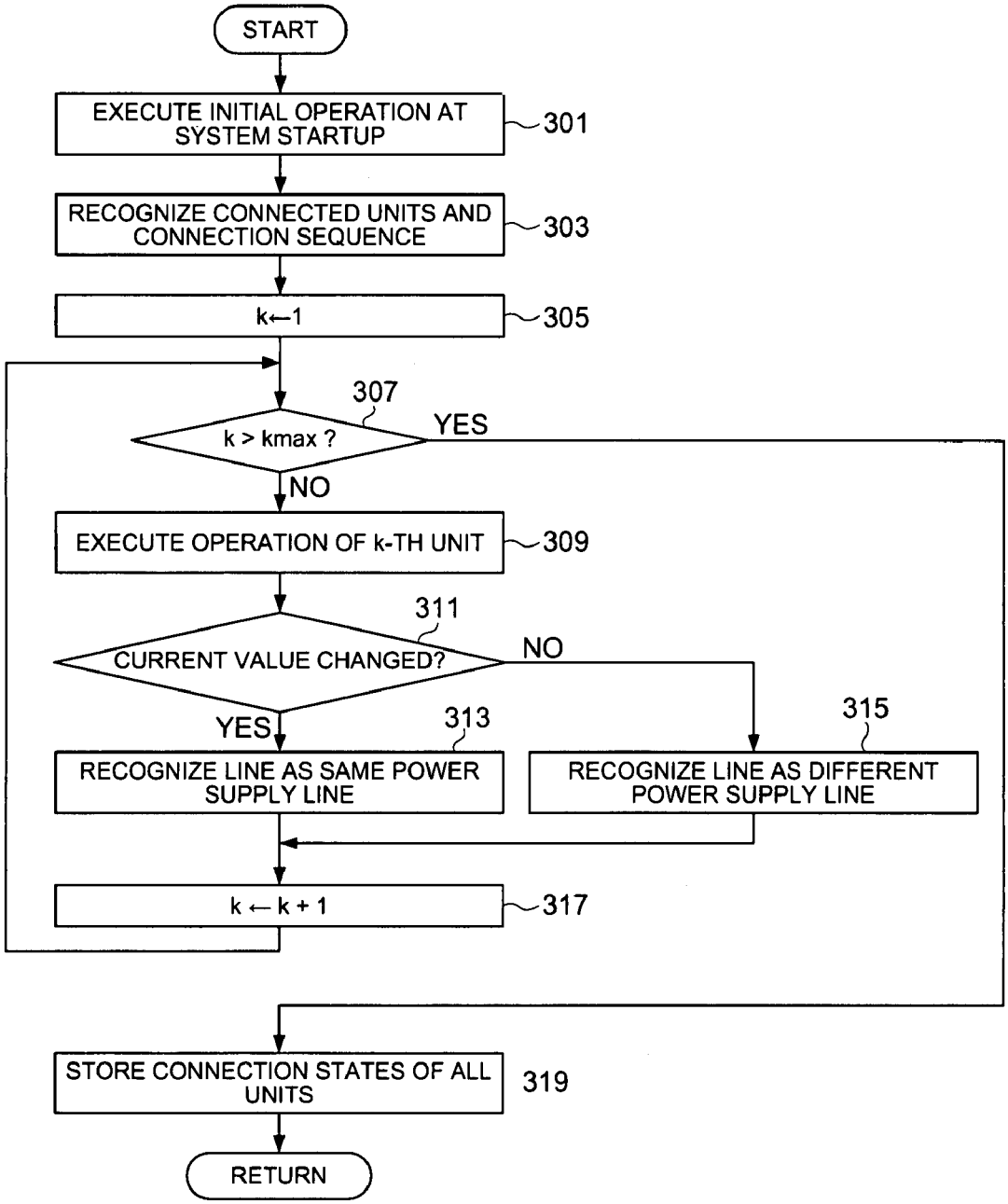
FIG. 7 is a flowchart indicating processing by a subroutine for recognizing connected post-processing units.

FIG. 7 is a flowchart for processing performed by the subroutine that recognizes connected units. First, initial processing during a system startup operation is performed in step 301, as shown in FIG. 7. In step 303, the control units in the post-processing units 2 to 6 perform processing after power-up to send information about their unit types and the like to the main control section 36 in the image forming unit 1 in the order of their connection through the serial communication interface 7. The main control section 36 recognizes the connected post-processing units and their connection order on the basis of the information.

In step 305, a counter value k, indicating a position in the connection sequence, is initialized to 1. In step 307, whether the counter value k exceeds kmax is then determined (As the kmax, the number of post-processing units connected, which is recognized in step 303, is set.). If a No result is produced, the sequence proceeds to step 309; if a Yes result is produced, the sequence proceeds to step 319. Here, since k is 1, a No result is produced and the sequence proceeds to step 309.

In step 309, the operation of a k-th unit is performed. Fluctuation of current detected by the current sensor 81 is monitored during the operation. Whether the current value detected by the current sensor 81 has changed is determined in step 311. If a Yes result is produced, the sequence proceeds to step 313; if a No result is produced, the sequence proceeds to step 315. In step 313, it is determined that the k-th unit is a unit on the power supply line to which power is supplied from the image forming unit 1, and the fact is set in the RAM. In step 315, it is determined that the k-th unit is a unit (for example, the post-processing unit 5 or 6 in FIG. 5(B)) on a different power supply line to which power is supplied from a different power supply from the image forming unit 1, and the fact is set in the RAM. In step 317 executed after step 313 or 315, the counter value k is incremented by one. After step 317 is executed, the sequence returns to step 307.

The processes in steps 307 to 317 are repeated until a Yes result is produced in step 307 to detect the power supply lines of the second to kmax units. When a Yes result is produced in step 307, the sequence proceeds to step 319. In step 319, data indicating whether the power supply line of each unit is from the image forming unit 1 or a different power supply is stored in a storage unit (not shown). Upon the completion of step 319, the process by the subroutine is terminated and control proceeds to step 203 in FIG. 6.

In step 203, the type of the job created on the basis of commands from the user is analyzed, and operation modes corresponding to the job are selected. When the analyzed job corresponds to, for example, commands for an ADF document, printing on both sides, and a stack operation, the LS operation modes are selected from the operation modes listed in the table in FIG. 4. When the analyzed job corresponds to commands for an ADF document, both sides, and a side-stitching operation, the FS operation modes are selected from the operation modes listed in the table in FIG. 4.

In step 205, the value of the current flowing in the image forming unit 1 is calculated with reference to the operation mode management table, in which the table in FIG. 4 is registered, for an operation mode which is predicted to take a maximum current out of the selected operation modes. In step 207, whether the calculated value is equal to or less than the allowable current (current rating) is determined. When a Yes result is produced, the sequence proceeds to step 209; when a No result is produced, the sequence proceeds to step 213.

In step 209, a full mode (LS full mode or FS full mode in FIG. 4) is set. In step 211, a job is executed in the full mode. In step 212, termination of the printing process is awaited.

In step 213 which is executed when a No result is produced in step 207, reduced current operation mode 1 is set. In step 214, reduced current operation mode 1 is executed. An operation mode as reduced current operation mode 1 is set such that the current flowing in the image forming unit 1 does not exceed the allowable current (current rating) even when the ADF operation is performed in the image forming unit 1.

In step 215, whether the ADF operation is completed is determined. When a No result is produced, the sequence proceeds to step 217; when a Yes result is produced, the sequence proceeds to step 221.

In step 217, the execution of reduced current operation mode 1 is continued. In step 219, whether the printing process is completed is determined. When a No result is produced, the sequence returns to step 215; when a Yes result is produced, the sequence proceeds to step 227.

Until the printing process is determined to be completed in step 219 or the ADF operation is determined to be completed in step 215, steps 215, 217, and 219 are repeatedly executed in that order, as described above.

When the ADF operation is determined to be completed in step 215, the sequence proceeds to step 221. In step 221, the operation mode changes to reduced current operation mode 2. In reduced current operation mode 2, the current flowing in the image forming unit 1 does not exceed the current rating while the ADF operation is not performed. In step 223, whether to start the ADF operation is determined. When a Yes result is produced, the sequence proceeds to step 217; when a No result is produced, the sequence proceeds to step 225. In step 217, the operation mode is changed to reduced current operation mode 1 described above. In step 225, whether the printing process is completed is determined. When a No result is produced, the sequence returns to step 223; when a Yes result is produced, the sequence proceeds to step 227.

Until the printing process is determined to be completed in step 225 or the ADF operation is determined to be started in step 223, steps 223 and 225 are repeatedly executed in that order, as described above.

That is, in this processing, reduced current operation mode 1 is executed while the ADF operation is performed until the printing process is completed; while the ADF operation is not performed, current reducing operation mode 2 is executed. Accordingly, the current flowing in the image forming unit 1 is adapted not to exceed the current rating during printing, and the units can be operated in an optimum operation mode in which each section is operated at its maximum current under the condition where the current flowing in the image forming unit 1 does not exceeds the current rating.

For example, suppose that the LS operation modes are set. While the ADF operation is performed, reduced LS mode 1 is executed. While the ADF operation is not performed, a margin is provided in the consumption current by a corresponding amount, so the image forming unit 1 is changed from the "printing on both sides+scan on both sides" operation mode to the "startup of printing after ADF stop" operation mode, the post-processing unit 6 is changed from the "only CPU operation" operation mode to the "standby" operation mode, and reduced LS mode 2 is set.

When the FS operation modes are set, reduced FS mode 1 is executed while the ADF operation is performed. While the ADF operation is not performed, a margin is provided in the consumption current by a corresponding amount, so reduced FS mode 2 is executed by, for example, changing the post-processing unit 5 from the "no other operations during stitching" operation mode to the "side-stitching, folding, and punching" operation mode.

When the printing process is determined to be completed in steps 212, 219, and 225, the sequence proceeds to step 227. In step 227, since all jobs have been completed, the operation of the apparatus is stopped and the apparatus is made to enter the standby state.

The flowchart shown in FIG. 6 indicates a flow of processing when the LS operation modes or FS operation modes, which have two reduced operation modes, are set as the operation modes. However, the PB operation modes, for example, may be set as the operation modes. Since the PB operation modes have only one type of reduced operation mode, when the PB operation modes are selected, it suffices to prevent steps 215, 217, 221, 223, and 225 from being executed.

Figure 8:
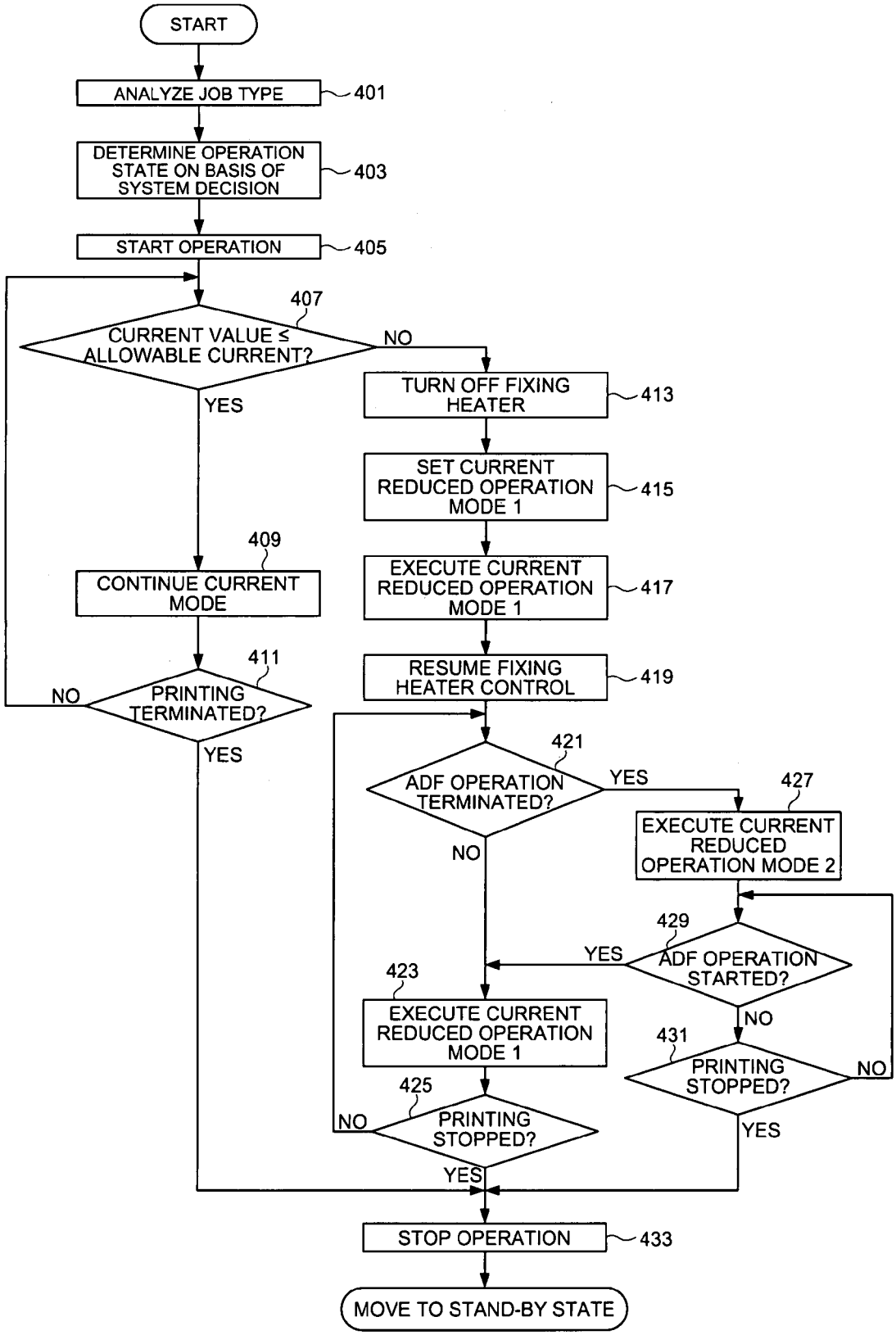
FIG. 8 is a flowchart indicating exemplary processing to change an operation mode while unit operation is in progress.

Next, the operation of the image forming system 100 during a system operation will be described. FIG. 8 is a flowchart for changing the operation mode of the main control section 36 during the system operation. As shown in FIG. 8, the type of a job is first analyzed in step 401. Operation modes that may be set are determined according to a system decision in step 403, and the operation of the individual units are started in the determined operation modes in step 405.

In step 407, it is determined whether a current detected by the current sensor 81 is less than or equal to the current rating. When a Yes result is produced, the sequence proceeds to step 409; when a No result is produced, the sequence proceeds to step 413. The current mode is continued in step 409, and then whether the job has been completed is determined in step 411. When a No result is produced, the sequence returns to step 407; when a Yes result is produced, the sequence proceeds to step 433. Accordingly, steps 407, 409, and 411 are repeatedly executed in that order until the job is determined to be completed.

In step 413 executed when the current value is determined to be more than the current rating in step 407, the fixing heater in the fixing section 35 is turned off. Hardware is used to turn off the fixing heater for an instance. Current reduced operation mode 1 is set in step 415, and executed in step 417. In step 419, control of the fixing heater in the fixing section 35 is resumed after the execution of the current reduced operation mode 1 is started.

The consumption current of the fixing heater is relatively as high as 10 A. When power supply to the fixing heater is stopped, therefore, it can be reliably avoided that the breaker trips before the operation mode is substantially changed by, for example, providing paper transfer intervals. Since control of the fixing heater is resumed at a level at which the ease of fixing images on paper sheets is not impaired, improper fixing can be avoided. Detailed explanation of processing performed in steps 421 to 431, which are executed subsequently, will be omitted because the processing is the same as the processing in steps 215 to 255 in FIG. 7. In step 433, the job operation is stopped and the job is placed in the standby state.

The power supply to the fixing heater is completely stopped temporarily during a period from step 413 to step 419, but it also suffices to just limit current to be supplied to the fixing heater during this period.

According to this embodiment, as described above, an operation mode is selected from a plurality of different operation modes corresponding to a job based on commands from the user so that, in the selected operation mode, the current flowing in the image forming unit 1 does not exceed the allowable current and that the operations of the image forming unit 1 and post-processing units 2 to 6 are optimally performed. The operations of the units are then restricted according to the selected operation mode. Accordingly, it is avoided that the breaker trips, and thus the units can operate optimally within their allowable currents without the printing and bookbinding job being stopped. As a result, safe image formation is achieved with high throughput.

According to this embodiment, the main control section 36 as a current value acquiring portion in the image forming unit 1 selects, from a plurality of different operation modes, an operation mode in which the current flowing in the main unit is maximized within its allowable current as the operation mode to optimally operate the units. This operations mode is considered to be an operation mode which avoids the breaker from tripping and enabling the printing and bookbinding job to be most optimally executed. Accordingly, when an operations mode is selected in this way, the printing and bookbinding job created according to a user's request can be efficiently executed.

Operation modes that can be set are not limited to the operation modes shown in FIGS. 3(A) to 3(E) and FIG. 4; other various operation modes can be used. The number of the current reduced operation modes in the PB, LS, and FS operation modes is not limited to 1 or 2 as described above. Three or more operation modes can also be used. In this case as well, the main control section 36 selects, from the three or more operation modes, an operation mode in which a maximum current flows in the main control section 36 within its allowable current.

In this embodiment, the main control section 36 switches operation modes between when the ADF operation is performed in the image forming unit 1 and when the ADF operation is not performed. Since the ADF operation can be performed independently of other operations in the image forming unit 1, this switchover of operation modes can be efficiently performed.

According to this embodiment, there is provided a current sensor 81 for detecting current flowing in the image forming unit 1. The main control section 36 recognizes which post-processing units are connected to the image forming unit 1 according to communications among the units (step 303 in FIG. 7), and individually operates the post-processing units connected to the image forming unit 1 (step 309 in FIG. 7). According to fluctuation in current detected by the current sensor 81 when the post-processing units are individually operated, the post-processing units that receive power from the image forming unit 1 are identified from the post-processing units recognized as being connected to the image forming unit 1 (steps 311 to 315 in FIG. 7). According to an operation management table, current calculation is performed as a calculation result of the maximum current flowing in the image forming unit 1 (step 205 in FIG. 6). It is thus possible to automatically determine whether the power to each post-processing unit is supplied or not from the image forming unit 1. This type of automatic connection determination is accurate without error, as compared with a case in which the connection is manually set. When the automatic connection determination is performed, the maximum current flowing in the image forming unit 1 can be calculated.

Furthermore, this type of automatic determination of power supply connection may be used to indicate, on the operation panel of the image forming unit 1, that a power supply not recommended is connected. It is thereby possible to avoid the breaker from tripping and achieve safe image formation.

According to this embodiment, recognition of the post-processing units 2 to 6 connected to the image forming unit 1 (step 303 in FIG. 7), the individual operations of the post-processing units 2 to 6 (step 309 in FIG. 7), identification of post-processing units to which power is supplied from the image forming unit 1 (steps 311 to 315 in FIG. 7), and current value calculation (step 205 in FIG. 6) are performed at an initial operation stage after power-up. It is thereby possible to avoid the breaker from tripping and achieve safe image formation, starting immediately after power-up.

According to this embodiment, when the current value detected by the current sensor 81 exceeds the allowable current, the main control section 36 of the image forming unit 1 imposes a limitation on the operation of each unit so that the current flowing in the image forming unit 1 falls to or below the allowable current. It is thereby possible to switch operation modes on the basis of the measured value of the current flowing in the image forming unit 1.

When the current value detected by the current sensor 81 exceeds the allowable current before the above operation mode switchover, the main control section 36 limits the current flowing in the fixing section 35 that fixes the image formed on a paper sheet by the image forming unit 1. The current flowing in the fixing section 35 is thus quickly limited when the current value exceeds the allowable current, so it is possible to prevent the operation from stopping due to a breaker trip.

If the above operation mode switchover can be quickly performed, however, there is no need to limit this power supply to the fixing heater.

In the above embodiment, the current sensor 81 is disposed near the inlet 11, but it may be disposed near the outlet 21. It is only necessary that the current sensor 81 is disposed in such a way that it can detect the current flowing in the power supply line of the image forming unit 1.

What is claimed is:

1. An image forming apparatus having a main body unit for forming an image on a recording medium, connectable to at least one post-processing unit for performing post-processing for the recording medium on which the image is formed, the image forming apparatus comprising:

a current value acquiring portion for acquiring at least one of a calculated value of a current flowing through the main body unit calculated based on a relation between an operation and a consumption current flowing in the main body unit and based on a relation between an operation and a consumption current flowing in each post-processing unit supplied an electric power from the main body unit, and a measured value of the current flowing through the main body unit, as a value of the current flowing through the main body unit; and a control portion for selecting an operation mode from a plurality of operation modes each having a distinct value of current flowing through the main body unit, wherein a control unit selects an operation mode to optimally operate each post-processing unit from the plurality of operation modes so that the value of the current flowing through the main body unit becomes below or equal to an allowable current value, in a case when the value of the current acquired by the current value acquiring portion exceeds the allowable current, and operating each unit according to selected mode.

2. The image forming apparatus of claim 1, wherein the control portion selects a mode with a maximum value of the current flowing through the main body unit from the plurality of different operation modes below the allowable current value, as the operation mode to optimally operate each post-processing unit.

3. The image forming apparatus of claim 2, wherein the control portion changes the operation mode depending on whether a document feed unit for feeding documents automatically is in operating or not.

4. Then image forming apparatus of claim 1, wherein the current value acquiring portion comprises a current detecting portion for detecting the current flowing through the main body unit and acquires a measured value of a current detected by the current detecting portion as the value of current flowing through the main body unit, and the control portion selects an operation mode having the value of the current flowing through the main body unit below or equal to the allowable current value and the selected operation mode optimally executes a job requested by a user, in a case when the measured value of the current detected by the current value acquiring portion exceeds the allowable current value during executing the job requested by the user.

5. The image forming apparatus of claim 2, wherein the current value acquiring portion comprises a current detecting portion for detecting the current flowing through the main body unit and acquires a measured value of a current detected by the current detecting portion as the value of current flowing through the main body unit, and the control portion selects an operation mode having the value of the current flowing through the main body unit below or equal to the allowable current value and the selected operation mode optimally executes a job requested by a user, in a case when the measured value of the current detected by the current value acquiring portion exceeds the allowable current value during executing the job requested by the user.

6. The image forming apparatus of claim 3, wherein the current value acquiring portion comprises a current detecting portion for detecting the current flowing through the main body unit and acquires a measured value of a current detected by the current detecting portion as the value of current flowing through the main body unit, and the control portion selects an operation mode having the value of the current flowing through the main body unit below or equal to the allowable current value and the selected operation mode optimally executes a job requested by the user, in a case when the measured value of the current detected by the current value acquiring portion exceeds the allowable current value during executing the job requested by the user.

7. The image forming apparatus of claim 4, further comprising a current restriction portion for restricting a current flowing in a fixing unit for fixing the image having formed on the recording medium in the main body unit since the measured value of the current detected by the current detecting portion exceeds the allowable current value until the restriction putting portion completes restricting an operation to each post operation unit.

8. The image forming apparatus of claim 5, further comprising a current restriction portion for restricting a current flowing in a fixing unit for fixing the image having formed on the recording medium in the main body unit since the measured value of the current detected by the current detecting portion exceeds the allowable current value until the restriction putting portion completes restricting an operation to each post operation unit.

9. An image forming apparatus of claim 6, further comprising a current restriction portion for restricting the current flowing in a fixing unit for fixing the image having formed on the recording medium in the main body unit since the measured value of the current detected by the current detecting portion exceeds the allowable current value until the restriction putting portion completes restricting an operation to each post operation unit.

10. An image forming system comprising: the image forming apparatus of claim 1; and at least one post-processing unit for performing post-processing for the recording medium on which the image is formed.

11. An image forming apparatus having a main body unit for forming an image on a recording medium, connectable to at least one post-processing unit for performing post-processing for the recording medium on which the image is formed, the image forming apparatus comprising:

a current detecting portion for detecting a current flowing through the main body unit;

a recognizing portion for recognizing a post-processing unit connected to the main body unit based on a content of a communication between units;

a specifying portion for specifying a post-processing unit as being supplied an electric power from the main body unit, from the post-processing units recognized as being connected to the main body unit by the recognizing portion, based on a current variation detected by the current detecting portion upon the post-processing being individually operated;

a current value acquiring portion comprising a calculating portion for calculating a maximum value of the current flowing through the main body unit based on a relation between a consumption current and a operation in main body unit and on a relations between a consumption current and an operation in a specified post-processing unit, for acquiring at least either one of a calculated value of the current flowing through the main body unit and a measured value of the current flowing in the main body unit as a value of current flowing through the main body unit; and a control portion for operating individually each post-processing unit connected to the main body unit, the control portion selecting an operation mode from a plurality of different operation modes to optimally operate each post-processing unit supplied an electric power from the main body unit upon the current value acquired by the current value acquiring portion exceeding an allowable current value so that the value of the current flowing through the main body unit becomes below or equal to an allowable current value, and operating each post-processing unit according to a selected operation mode.

12. The image forming apparatus of claim 11, wherein, during an initial operation stage after power-up, the current detecting portion detects the current following through the main body unit, the recognizing portion recognizes the post-processing units connected to the main body unit, the control portion operates the post-processing units individually, the specifying portion specifies post-processing units supplied the electric power from the main body unit, and the current value acquiring portion calculates the maximum current.

13. An image forming system comprising: the image forming apparatus of claim 11; and at least one post-processing unit for performing post-processing for the recording medium on which the image is formed.

14. An image forming system comprising: the image forming apparatus of claim 12; and at least one post-processing unit for performing post-processing for the recording medium on which the image is formed.

* * * * *